US005344134A

United States Patent [19]

Saeki et al.

[11] Patent Number: 5,344,134

[45] Date of Patent: Sep. 6, 1994

[54] AUTOMATIC DOCUMENT FEEDER FOR AN IMAGE FORMING APPARATUS

[75] Inventors: Shirou Saeki, Yokohama; Akira Hirose, Tokyo; Takashi Fujii, Omiya; Motoya Sano, Tokyo, all of Japan

[73] Assignee: Ricoh Company, Ltd., Tokyo, Japan

[21] Appl. No.: 142,930

[22] Filed: Oct. 29, 1993

[30] Foreign Application Priority Data

Nov. 11, 1992 [JP] Japan ..... 4-300717

[51] Int. Cl.[5] ..... B65H 3/52

[52] U.S. Cl. ..... 271/122; 271/10; 271/110; 271/272

[58] Field of Search ..... 271/3.1, 10, 122, 272, 271/110, 265

[56] References Cited

U.S. PATENT DOCUMENTS 4,105,199 8/1978 Sato et al. ..... 271/122
4,957,285 9/1990 Yamada ..... 271/3.1

FOREIGN PATENT DOCUMENTS 48139 4/1980 Japan ..... 271/122
202536 8/1988 Japan .
193844 7/1990 Japan ..... 271/10
216437 9/1991 Japan ..... 271/122

*Primary Examiner*—Robert P. Olszewski
*Assistant Examiner*—Boris Milef
*Attorney, Agent, or Firm*—Oblon, Spivak, McClelland, Maier & Neustadt

[57] ABSTRACT

In an automatic document feeder (ADF) for an image forming apparatus, a table is loaded with multiple documents or a single document, as desired. A transport section transports the document or one of the documents fed from the table to a predetermined position on a glass platen included in a body of the apparatus, and then transports it away from the predetermined position. A feed section has a feeding member for feeding the document from the table to the transporting section, and a separating member movable in opposite direction to an intended direction of document feed into frictional engagement with the feeding member. A mode selecting section is accessible for selecting either of a multiple feed mode for sequentially feeding the multiple documents from the table while separating the individual documents, and a single feed mode for feeding the single document therefrom. A drive source drives the separating member while switching the drive direction thereof. A controller controls the drive source such that when the multiple feed mode is selected, the separating member contacts the feeding member with friction acting therebetween, while when the single feed mode is selected, the former contacts the latter without friction acting therebetween. In the single feed mode, the separating member is driven in the feed direction and feeds a document in cooperation with the separating member, thereby preventing the document from being damaged or displaced.

9 Claims, 13 Drawing Sheets

AUTOMATIC DOCUMENT FEEDER FOR AN IMAGE FORMING APPARATUS

BACKGROUND OF THE INVENTION

The present invention relates to an automatic document feeder (ADF) for a copier, printer or similar image forming apparatus and, more particularly, to an ADF capable of protecting a document fed in a single document feed mode from damage and displacement.

An ADF of the type feeding a document from a table to a predetermined position on a glass platen included in an image forming apparatus, and then discharging the document having been scanned or illuminated is conventional. This type of ADF is disclosed in Japanese Patent Laid-Open (Kokai) No. 202536/1988 by way of example. The conventional ADF includes a separation roller for separating individual documents stacked on the table, and a feed belt for feeding the lowermost document separated from the stack to the glass platen. The problem with this kind of ADF is that, among others, when it feeds a cut and pasted document, a perforated document, a curled document or a document having great frictional resistance, it is apt to dislocate the document or even damage it due to the contact resistance acting between the document and the separation roller.

SUMMARY OF THE INVENTION

It is, therefore, an object of the present invention to provide an ADF for an image forming apparatus which, when a single document feed mode is selected, drives a separating member in an intended direction of document feed and causes it and a feeding member to nip and transport the document, thereby protecting the document from damage and dislocation.

An ADF for an image forming apparatus of the present invention has a table to be loaded with multiple documents or a single document, as desired. A transport section transports the document or one of the documents fed from the table to a predetermined position on a glass platen included in a body of the apparatus, and then transports it away from the predetermined position. A feed section has a feeding member for feeding the document from the table to the transporting section, and a separating member movable in opposite direction to an intended direction of document feed into frictional engagement with the feeding member. A mode selecting section is accessible for selecting either of a multiple feed mode for sequentially feeding the multiple documents from the table while separating the individual documents, and a single feed mode for feeding the single document therefrom. A drive source drives the separating member while switching the drive direction thereof. A controller controls the drive source such that when the multiple feed mode is selected, the separating member contacts the feeding member with friction acting therebetween, while when the single feed mode is selected, the former contacts the latter without friction acting therebetween. In the single feed mode, the separating member is driven in the feed direction and feeds a document in cooperation with the separating member, thereby preventing the document from being damaged or displaced.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 14:
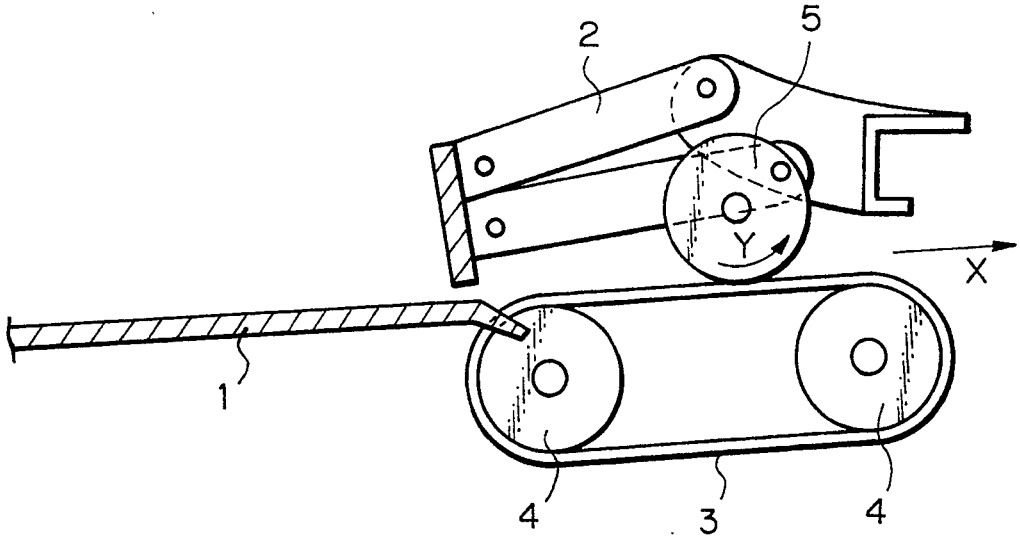
Fig. 14 PRIOR ART
FIG. 14 is a fragmentary section of a conventional ADF.

To better understand the present invention, a brief reference will be made to an ADF disclosed in the previously mentioned Kokai No. 202536/1988. As shown in FIG. 14, the conventional ADF has a table 1 to be loaded with a stack of documents, not shown. A separation roller 5 separates the individual documents one by one. A feed belt 3 is passed over and driven by a pair of rollers 4 to convey the separated document to a glass platen, not shown. A presser 2 presses the belt 3 with a predetermined force so as to press the document stack. In this configuration, the lowermost document is separated from the stack by the roller 5. The belt 3 transports the document in a direction indicated by an arrow X to a position for illumination defined on the glass platen by way of a transport path, not shown. Since the table 1 is disposed above the glass platen, the documents are stacked on the table 1 face up and turned over on the transport path.

The ADF is capable of sequentially feeding multiple documents stacked on the table 1 (referred to as an ADF mode hereinafter) or feeding a single document set on the table 1 (referred to as an SADF mode hereinafter). In the ADF mode, assume that cut and pasted documents, perforated documents, curled documents or documents having great frictional resistance, e.g., thermosensitive papers are fed one by one. Then, the separation roller 5 is apt to break or otherwise damage the documents since it rotates in such a manner as to return them toward the table 1. Further, it is likely that such documents jam the transport path, or two or more of them are fed together. The SADF mode mentioned above is selected to eliminate these problems. In the SADF mode, the roller 5 is disconnected from a drive source assigned thereto and caused to rotate in a direction indicated by an arrow Y due to the friction acting between it and the document. Alternatively, in the SADF mode, the separation roller 5 may be spaced a predetermined distance from the belt 3, i.e., from the document so as to protect the document from damage.

The conventional ADF described above has the following problems. When the SADF mode is selected, the separation roller 5 is rotated by the document being driven in contact with the roller 5. Therefore, when the document is of the kind easy to be damaged, the roller 5 is apt to damage it due to the contact resistance. Since the document is turned over while being conveyed on the transport path, it rubs itself against a wall, not shown, delimiting the path. This is apt to damage the document or to cause it to jam the transport path.

Assume that in the SADF mode the separation roller 5 is spaced a predetermined distance from the feed belt 3, as stated above. In this case, the roller 5 cannot be sufficiently spaced apart from the belt 3 and is positioned as if it were a guide for the document. In this condition, it is impossible to prevent the roller 5 from contacting the document. It follows that when a document defectively cut and pasted is fed or a small number of documents bound together is fed by accident, the document or documents are displaced on contacting the roller 5 or even damaged due to the displacement.

Figure 3:
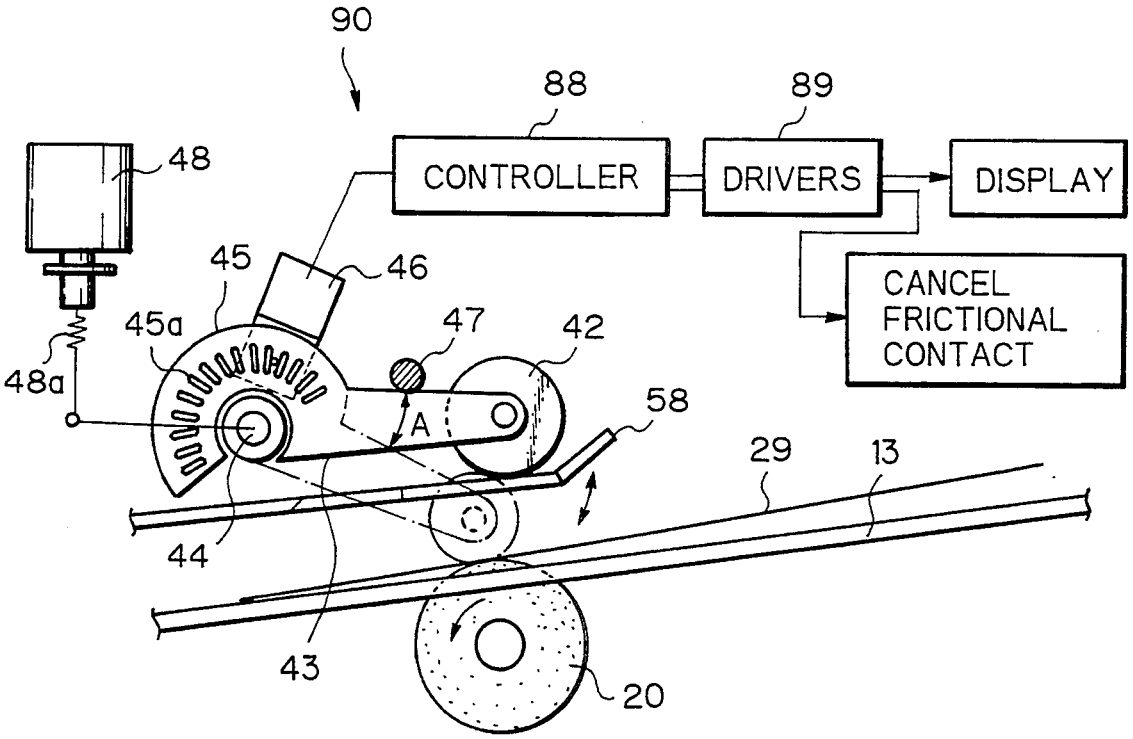
FIG. 3 is a view of another essential part of the embodiment on which a single document is set.
Figure 4:
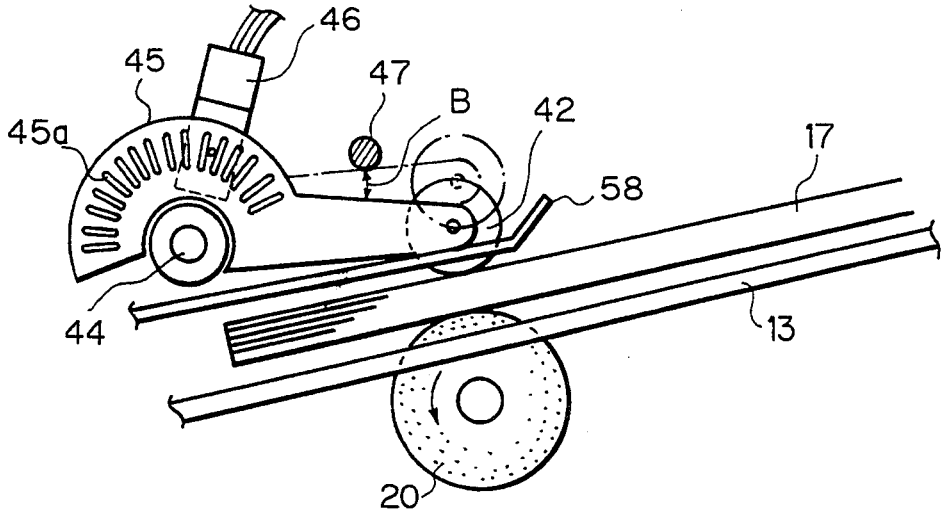
FIG. 4 is a view showing the part of FIG. 3 on which multiple documents are set.
Figure 5:
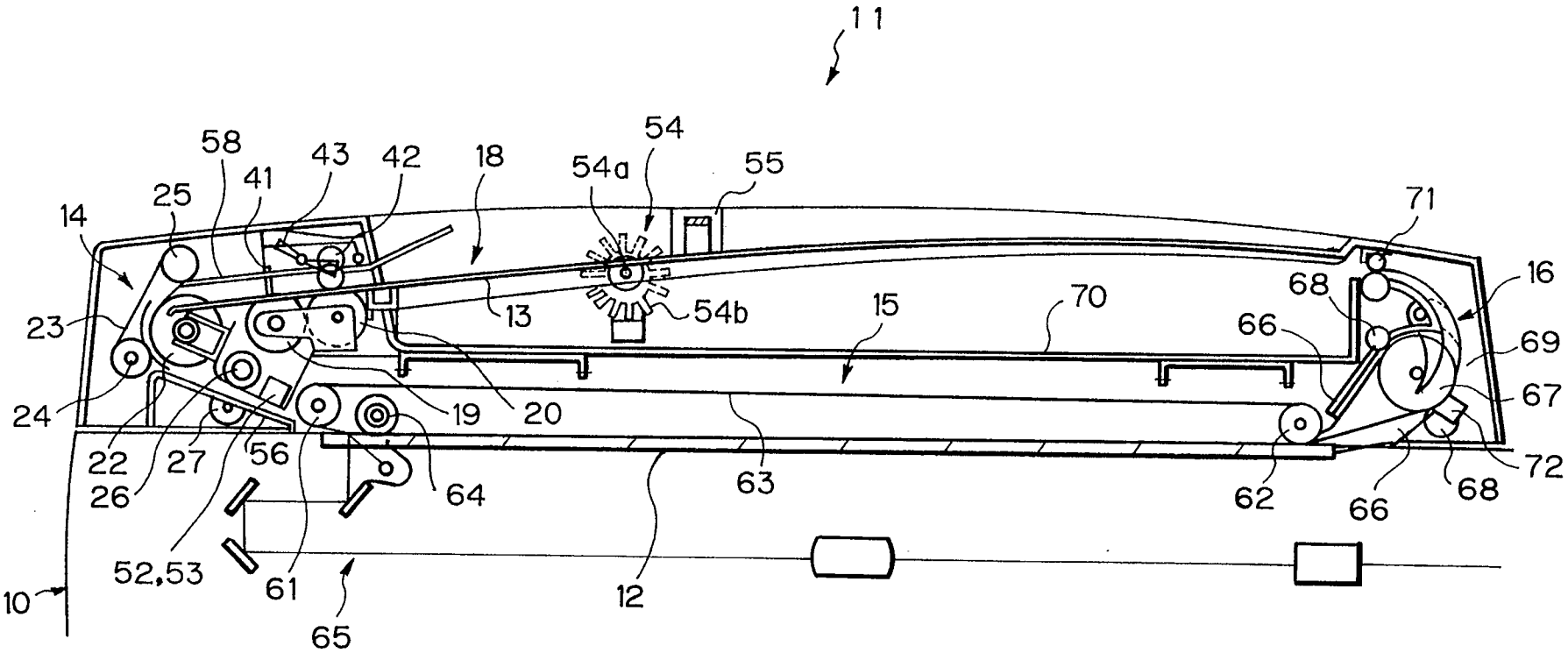
FIG. 5 is a section showing the general construction of the embodiment.

Referring to FIGS. 1–7, an-ADF embodying the present invention will be described which eliminates the problems discussed above. As shown in FIG. 5, the ADF, generally 11, is mounted on a copier body 10 and covers a glass platen 12 provided on the top of the copier body 10. The ADF 11 is selectively operable in the ADF mode (multiple or in the SADF mode (single feed mode). The ADF mode or the SADF mode is selected on mode selecting means, not shown. The ADF 11 has a table 13 to be loaded with a single document or a stack of multiple documents. A feed section 14 picks up a document set on the table 13 and feeds it toward the glass platen 12. A transport section 15 transports the document fed from the feed section 14 to the glass platen 12. A turn-over section 16 selectively discharges the document driven out of the glass platen 12 by the transport section 15, or turns it over and then returns it to the transport section 15.

Figure 1:
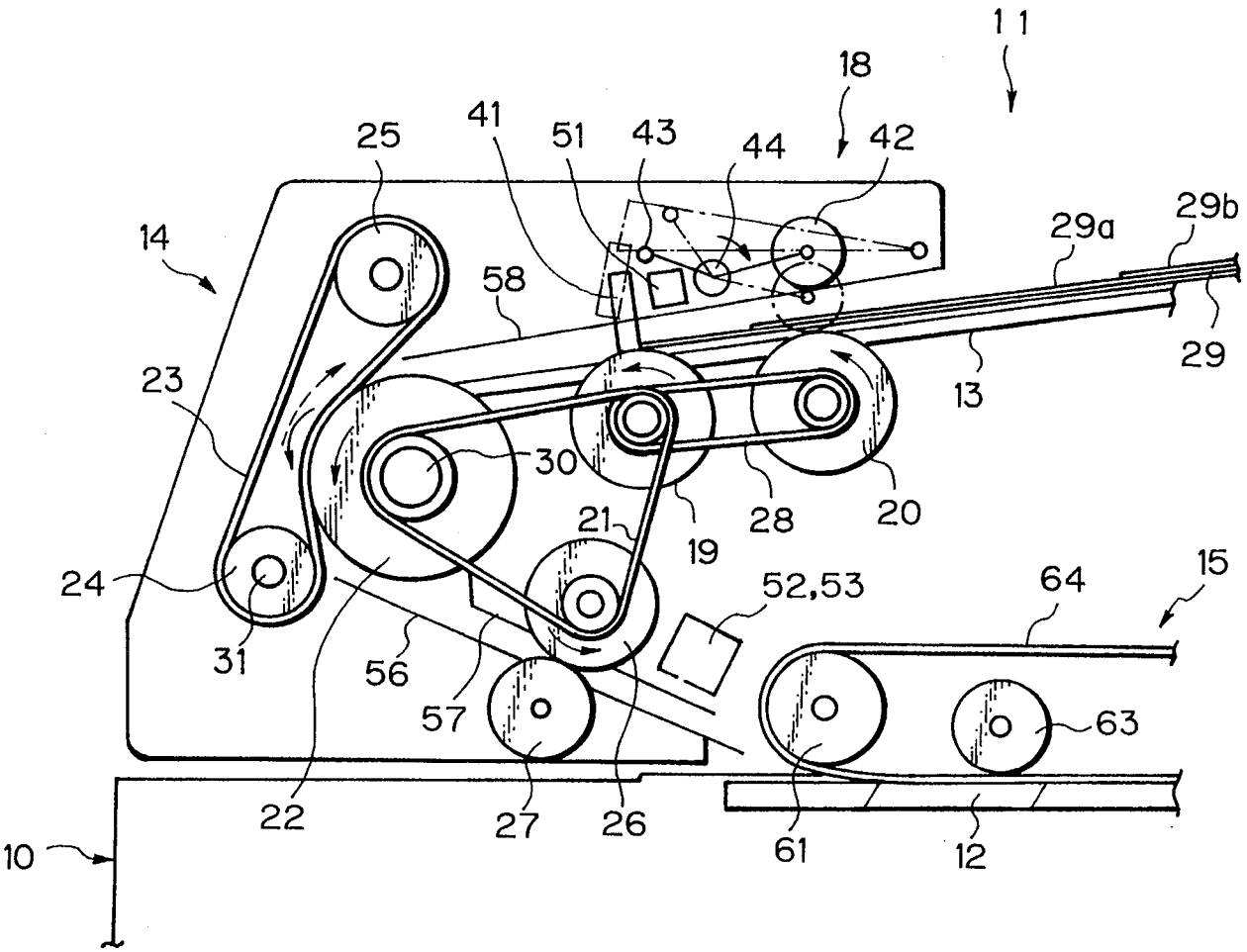
FIG. 1 is a fragmentary section of an ADF embodying the present invention.

As shown in FIGS. 1 and 5, in the feed section, the table 13 is located above the glass platen 12. A document set portion 18 is included in the table 13 to be loaded with a document or documents. A plurality of pick-up rollers 19 and 20 drive the document or documents to the left as viewed in FIG. 1. A feed roller, or feeding member, 22 feeds the document picked up by the pick-up rollers 19 and 20. A separation belt 23 is held in contact with the feed roller 22 over a predetermined area. The belt 23 is passed over and driven by a pair of pulleys 24 and 25. A pair of pull-out rollers 26 and 27 drives the document fed by the feed roller 22 to the transport section 15. An endless belt 21 is passed over the shafts of the pick-up roller 19, feed roller 22 and pull-out roller 26 to transmit the rotation of the roller 22 to the rollers 19 and 26. An endless belt 28 transmits the rotation transmitted to the pick-up roller 19 further to the pick-up roller 20. The separation belt 23 and at least one of the pulleys 24 and 25 are respectively provided with a first and a second meshing portion, although not shown in the figures. The first and second meshing portions are held in mesh with each other to maintain the pulley 24 or 25 and the belt 23 in engagement. This successfully prevents the contacting surfaces of the feed roller 22 and separation belt 23 from being displaced.

Figure 2:
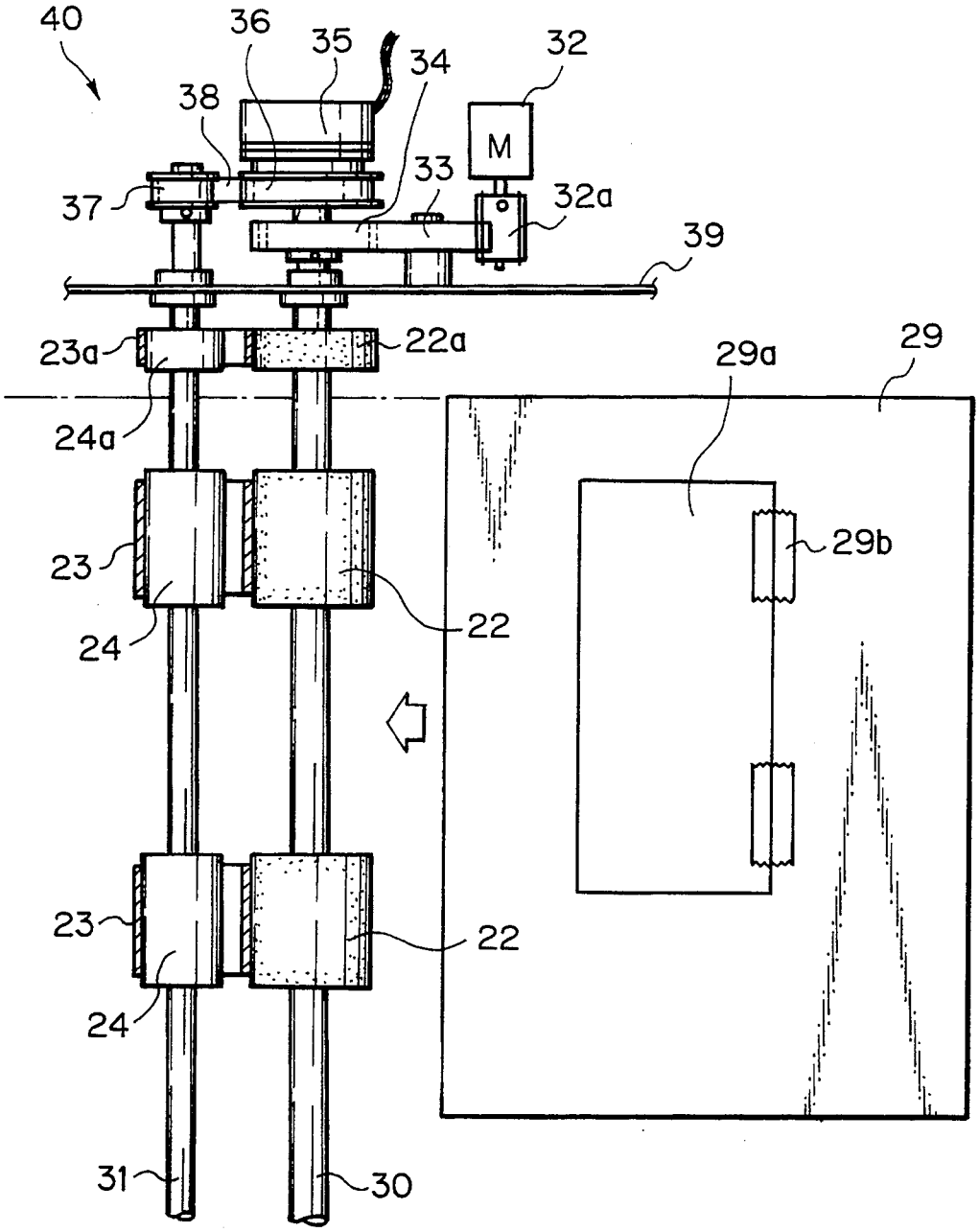
FIG. 2 is a fragmentary plan view of an essential part of the embodiment.

Specifically, as shown in FIG. 2, the feed roller 22 and the pulley 24 are supported and rotated by a shaft 30 and a shaft 31, respectively. A pulley, or first engaging member, **22*a* and a drive gear 34 are mounted on the shaft 30. The pulley 22*a* has substantially the same configuration with the feed roller 22 in cross-section. As a motor 32 is rotated, it rotates the drive gear 34 via a motor gear 32*a* and a gear 33. A clutch 35 is selectively coupled or uncoupled to connect or disconnect a pulley 36 to or from the shaft 30. Affixed to the shaft 31 are a pulley, or second engaging member, 24*a* and a pulley 37. The pulley 24*a* has substantially the same configuration as the pulley 24 in cross-section. An endless belt 38 is passed over the pulleys 36 and 37 to transmit the rotation of the motor 32 to the pulley 37. A drive belt, or second engaging member, 23*a* is passed over the pulley 24*a* and a pulley, not shown. The drive belt 23*a* is substantially identical with the separation belt 23 in a sectional view perpendicular to the axis of the drive shaft 31. The pulleys 22*a* and 24*a*, as well as the pulley, not shown, and the drive belt 23*a* are located at the side of the document transport path, so that the document may not be nipped by the belt 23*a* and pulley 22*a*. The pulleys 22*a* and 24*a* and the belt 23*a* are substantially identical in configuration with the feed roller 22 and pulleys 24 and 25 and the belt 23, respectively. In this arrangement, the drive belt 23*a* contacts the pulley 22*a* over a predetermined area. When the clutch 35 is uncoupled, the pulley 24*a* is surely driven due to the contact resistance of the drive belt 23*a* and pulley 22*a*. Hence, the contacting surfaces of the pulley 22*a* and belt 23*a* are prevented from being displaced. The pulley 22*a*** is provided with the previously mentioned second meshing portion.

In operation, assume that multiple documents 17, FIG. 4, are stacked on the table 13, and then the ADF mode is selected on the mode selecting means. Then, the clutch 35 is coupled to securely connect the pulley 36 to the shaft 30. In this condition, the rotation of the motor 32 is transmitted to the feed roller 22 via the motor gear **32*a*, drive gears 33 and 34, and shaft 30, thereby rotating the roller 22 counterclockwise, i.e., in a feed direction. At the same time, the rotation of the shaft 30 is transmitted to the pulley 24 via the pulley 36, belt 38, pulley 37, and shaft 31. As a result, the pulley 24 is rotated clockwise to rotate the separation belt 23 in a direction indicated by an arrow in FIG. 1. This causes friction to act between the belt 23 and the feed roller 22 contacting each other. Consequently, the roller 22 feeds only the lowermost document from the stack 17 to the transport section 15**.

On the other hand, assume that a single document 29 easy to be damaged, e.g., a document 29 prepared by cutting another document **29*a* and adhering it to the document 29 by an adhesive tape 29*b* is set on the table 13, and then the SADF mode is selected. In this case, the clutch 35 is uncoupled to release the pulley 36 from the shaft 30. As the feed roller 22 is rotated counterclockwise (feed direction), the pulleys 24*a* and 24 are rotated in the opposite direction to the feed direction due to the contact of the belt 23*a* and the pulley 22*a*. Consequently, the separation belt 23 is driven in a direction indicated by a phantom arrow in FIG. 1, i.e., follows the movement of the feed roller 22. It follows that the belt 23 and roller 22 nip the document 29 and drive it toward the transport section 15** while turning it over.

A registration sensor 52 is located downstream of the pull-out rollers 26 and 27. The belt 23 is continuously driven until the registration sensor 52 senses the trailing edge of the document. In this sense, the belt 23 and pulleys 24 and 25 constitute a separating member in combination, while the roller 22 and belt 23 form a turn-over path for turning over a document. Further, the clutch 35, pulleys 36 and 37, belt 38, pulleys 22*a* and 23*a*, pulley, not shown, and belt 23*a* play the role of drive means 40 for driving the separating member. It is to be noted that the shafts 30 and 31 and gear 33 are rotatably supported by the side walls 39 of the ADF 11.

The document set portion 18 will be described with reference to FIGS. 1 and 3–5. As shown, the portion 18 includes a stop 41 for regulating the position of the document or documents on the table 13. A press roller 42 presses the pick-up roller 20 from the above so as to surely drive the document set on the table 13. A lever 43 moves the press roller 42 downward to press the document and lifts the stop 41 to allow the document to be fed. The lever 43 is mounted on and rotated by a shaft 44. A disk portion 45 is contiguous with the lever 43 and formed with slits 45*a* extending radially away from the axis of the shaft 44. A photointerrupter 46 determines the angular position of the lever 43 by sensing the slits 45*a* of the disk portion 45. A stop 47 restricts the upward movement of the lever 43. A solenoid or similar drive source 48 rotates the lever 43 to move the press roller 42 in a circular motion. A spring or similar shock absorbing member 48*a* is connected to the drive source 48. The press roller 42 is made of a light substance and provided with a relatively large diameter so as not to exert a load on the document.

In a stand-by condition, the document set portion 18 maintains the press roller 42 in a raised position and the stop 41 in a lowered position via the lever 43. Assume that a single document is set on the table 13, and then a start key, not shown, provided on the copier body 10 is pressed. Then, as shown in FIG. 3, the drive source 48 rotates, i.e., lowers the lever 48 away from the stop 47 until the press roller 42 contacts the document 29, as indicated by a dash-and-dot line in the figure. At this instant, the photointerrupter 46 senses the slits 45*a* of the disk portion 45 and sends data representative of the rotation angle (A, FIG. 3) of the lever 43 to a main control section 80 which will be described. As shown in FIG. 4, when multiple documents 17 are stacked on the table 13, the lever 43 is rotated to move the press roller 42 from a dash-and-dot line position to a position where it contacts the stack 17. Again, the photointerrupter 46 sends data representative of the rotation angle of the lever 43 to the main control section 80.

As shown in FIG. 5, the feed section 14 further includes a document set sensor 51 responsive to a document or documents set on the table 13. A width sensor 53 is located at one side of the registration sensor 52 in the direction perpendicular to the feed direction so as to determine the width of a document. Length sensing means 54 is implemented by an encoder 54*b* responsive to the rotation of a roller 54*a* which is rotated by a document being fed. The sensing means 54 is located at the rear of the document set portion 18 in the feed direction and is located at at one side of a roller 54*a* in the direction perpendicular to the feed direction so as not to contact the roller 54*a* or the document. A pressing member 55 is rotatable counterclockwise to press the document against the roller 54*a*, thereby surely rotating the roller 54*a*. Also provided in the feed section 14 are guides 56, 57 and 58 for guiding the document in the feed direction. The pressing member 55 may not be operated when the document 29 easy to be damaged is set on the table 13.

As shown in FIG. 5, the transport section 15 has an endless belt 63 passed over a pair of rollers 61 and 62, and a plurality of rollers 64 urging the lower run of the belt 63 against the glass platen 12. When a belt motor, not shown, is driven, the transport section 15 conveys the document coming out of the feed section 14 to a predetermined position on the glass platen 12 where illuminating means 65 included the copier body 10 illuminates or scans it. After the document has been illuminated by the illuminating means 65, the transport section 15 conveys the document from the glass platen 12 to the turn-over section 16.

As shown in FIG. 5, the turn-over section 16 has a curved guide 66 extending upward from the right-hand side of the glass platen 12, as viewed in the figure. A turn-over roller 67 extends along the guide 66. A press roller 68 is pressed against the turn-over roller 62. A path selector, or pawl, 69 selects a path for discharging the document brought out of the glass platen 12 or a path for turning over the document and returning to the transport section 15. The documents driven out of the glass platen 12 are sequentially stacked on a stacker 70. A sensor 72 senses the leading edge of the document coming out of the transport section 15. Assume that the document to be copied is two-sided. Then, as soon as the sensor 72 senses the leading edge of the document, the path selector 69 is shifted to a position indicated by a dash-and-dot line in the figure. In this condition, the turn-over roller 67 turns over the document and feeds it again to the transport section 15. In the case of a one-sided document, when the sensor 72 senses the leading edge of the document, the path selector 69 is brought to a solid line position. Therefore, the turn-over roller 67 drives the document to a discharge roller 71. As a result, the document is driven out to the stacker 70 by the discharge roller 71.

Figure 6:
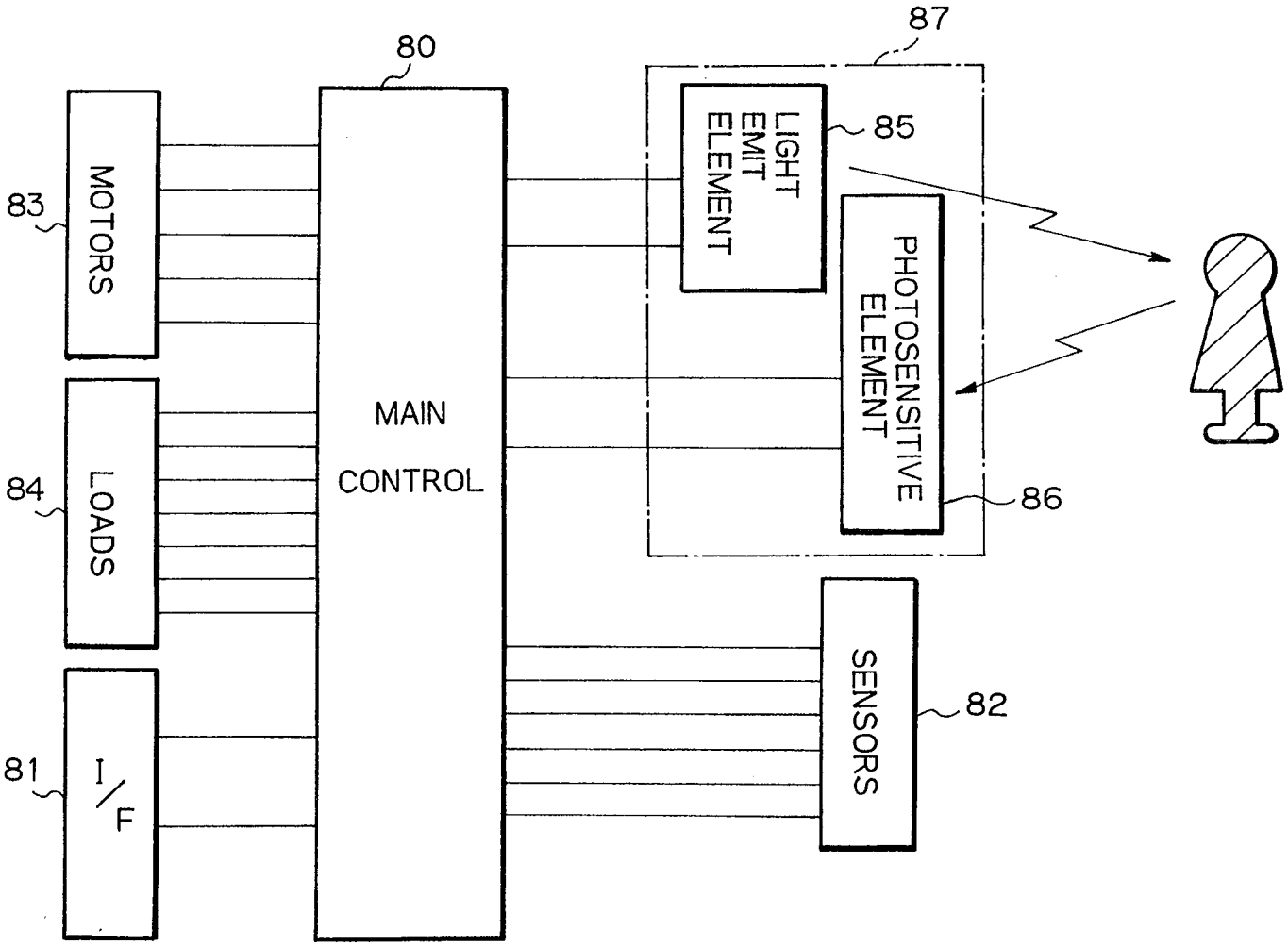
FIG. 6 is a block diagram schematically showing a control system incorporated in the embodiment.

As shown in FIG. 6, the feed section 14, transport section 15 and turn-over section 16 are controlled by the main control section 80 which is connected to the copier body 10 by an interface 81. The main control section 80 causes a document to be fed in response to a command from the copier body 10. The control section 80 includes a CPU (Central Processing Unit), a memory, and an I/O (Input/Output) circuit, although not shown specifically, and stores a control program (subroutine included in a main program) in the memory. The control section 80 controls motors 83 including the motor 32 and belt motor, and various loads 84 including the press roller drive source 48, in response to commands from the copier body 10, the outputs of the sensors 51, 52, 53 and 72, and the output of the photointerrupter 46 associated with the lever 43. Further, the control section 80 is connected to operator sensing means 87 made up of a light emitting element 85 and a photosensitive element 86. When an operator stands at a predetermined position, light issuing from the light emitting element 85 is reflected by the operator toward the photosensitive element 86.

Assume that while the SADF mode is set up, multiple documents 17 are stacked on the table 13, and then the start key is pressed. Then, the photointerrupter 46 sends data representative of the resulting rotation angle of the lever 43 to a controller 88, FIG. 3, included in the main control section 80. In response, the controller 88 determines that multiple documents 17 are stacked on the table 13, and then controls drivers 89, FIG. 3, which drive the motor 83 and loads 84. As a result, a document feeding operation is inhibited. At the same time, a message for urging the operator to replace the SADF mode with the ADF mode appears on a display, FIG. 3. Specifically, the controller 88 counts the outputs of the photointerrupter 46 to see if a single document or multiple documents are set on the table 13. More specifically, the controller 88 sequentially decrements the count as the thickness of the stack increases, and determines that multiple documents are set when the count decreases to "19" or less. In this sense, the press roller 42, slitted disk portion 45, photointerrupter 46 and controller 88 constitute sensing means 90 responsive to the total thickness of documents.

Further, the main control section 80 has a start timer and an absence timer. When the SADF mode is selected on the mode selecting means, the start timer counts the interval between the selection of the SADF mode and the operation of the start key. The absence timer counts the time for which the operator is away away from the predetermined position. When the time of the start timer or that of the absence timer is over, the main control section 80 automatically switches the operation from the SADF mode to the ADF mode. The absence timer and the start timer (sometimes referred to as timers TM1 and TM2, respectively, hereinafter) are implemented by the timer function of the CPU. The start timer starts and ends counting time in response to the output of the operator detecting means 87. The timers TM1 and TM2 are turned on or turned off when timer flags 1 and 2 (or TMFLGs 1 and 2 as sometimes referred to hereinafter), respectively, are set or reset.

Figure 7A:
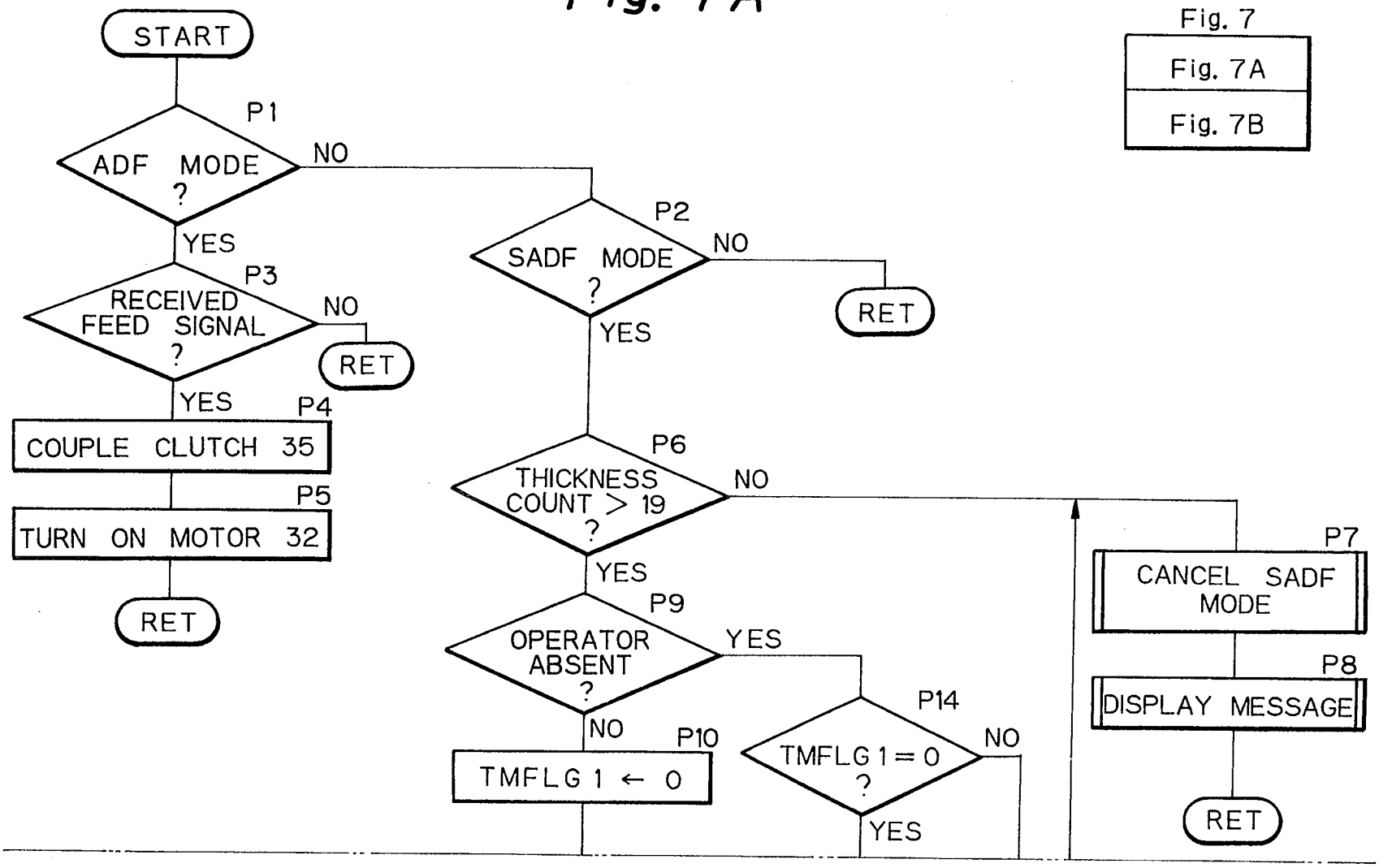
FIG. 7 is a flowchart demonstrating a specific operation of the embodiment.
Figure 7B:
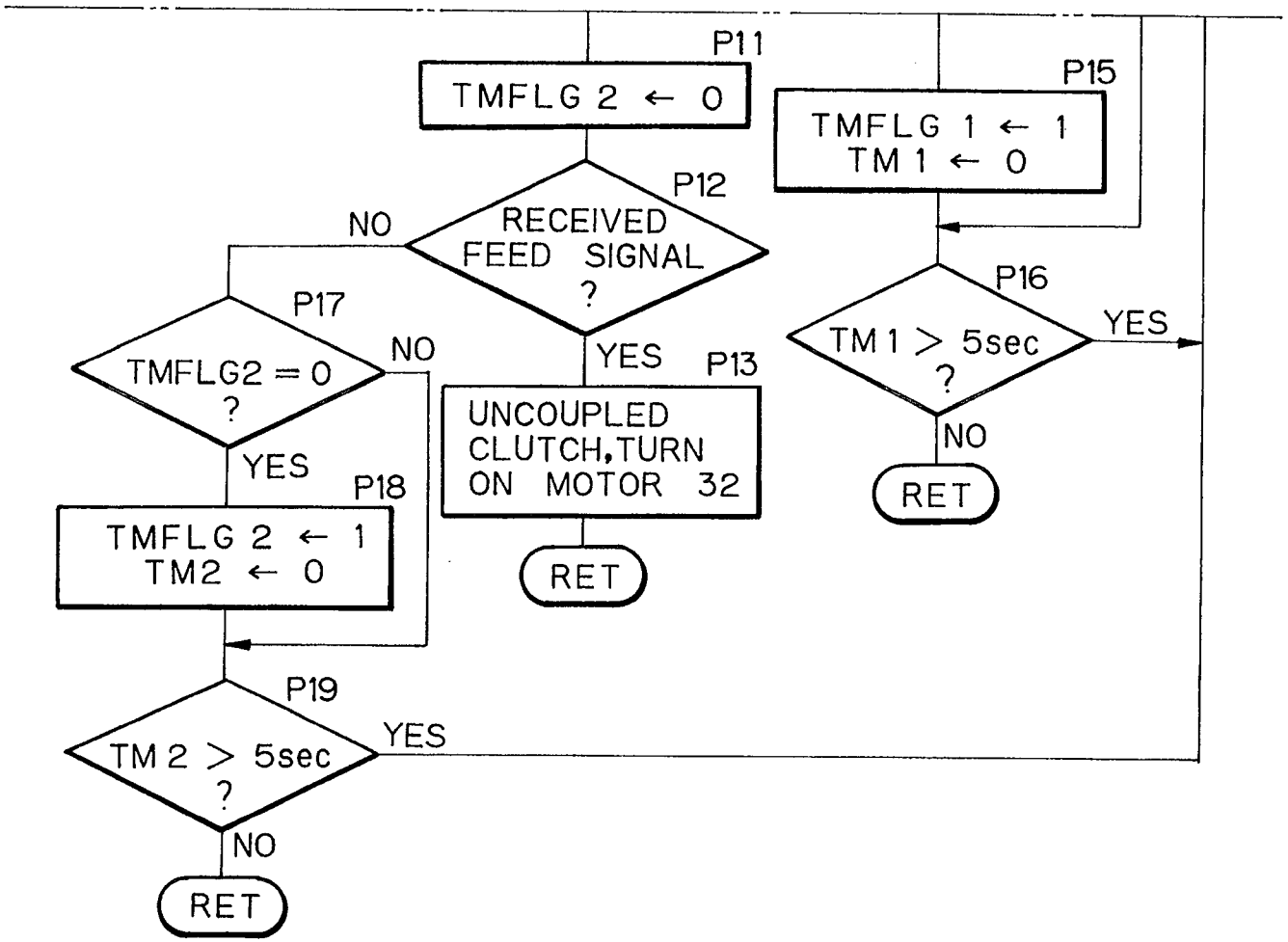

Referring to FIG. 7, the control program to be executed by the main control section 80 will be described specifically. As shown, the control section 80 determines whether or not the ADF mode has been selected on the mode selecting means (step P1). If the ADF mode has not been selected (NO, step P1), the program advances to a step P2. If it has been selected (YES, step P1), the control section 80 determines whether or not the copier body 10 has sent a feed signal in response to the operation of the start key (step P3). If the answer of the step P3 is negative, NO, the program returns to the main program; if otherwise, the control section 80 couples the clutch 35 (step P4) and drives the motor 32 (step PS) to thereby cause the ADF to start feeding a document.

In the step P2, the control section 80 determines if the SADF mode has been selected on the mode selecting means or not. If the answer is negative, NO, the program returns to the main program; if otherwise, the control section 80 determines whether or not the count of the sensing means 90 representative of the total thickness of documents has exceeded "19" (step P6). If the count is "19" or less (NO, step P6), the control section 80 cancels the SADF mode and inhibits the ADF from feeding a document (step P7). At the same time, the control section 80 displays an SADF mode inhibition message on the display (step P8) while automatically replacing the SADF mode with the ADF mode. If the answer of the step S6 is positive, YES, the control section 80 determines if the operator detecting means 87 has detected an operator (step P9). If an operator is absent at the predetermined position (YES, step P9), the program advances to a step P14; if otherwise, the control section 80 resets the timer flag TMFLG1 (step P10) and resets the timer flag TMFLG2 (step P11). Subsequently, the control section 80 determines whether or not the start key has been pressed and the copier body 10 has sent a feed signal (step P12). If the answer of the step P12 is negative, NO, the program advances to a step P 17; if otherwise, the control section 80 uncouples the clutch 35 and drives the motor 32 (step P13) to cause the ADF to start feeding a document.

In the step P14, the control section 80 determines whether or not the timer flag TMFLG1 has been reset. If the flag TMFLG1 has been reset (YES, step P14), the control section 80 sets the flag TMFLG1 and resets the timer TM1 (step P15). As a result, the absence timer starts counting the absence time of the operator. If the timer TMFLG1 has not been reset (NO, step P14), the timer TM1 continuously counts the time. When the timer TM1 has counted 5 seconds (YES, step P16), the control section 80 cancels the SADF mode and stops a document feeding operation (step P7). Again, the control section 80 displays the SADF mode inhibition message on the display (step P8) and sets up the ADF mode in place of the SADF mode. If the timer TM1 is short of 5 seconds (NO, step P16), the program returns to the main program.

In the step P17, the control section 80 determines whether or not the timer flag TMFLG2 has been reset. If the answer of the step P17 is positive, YES, the control section 80 sets the flag TMFLG2 and resets the timer TM2 (step P18). As a result, the start timer starts counting the interval between the operation of the start key and the start of a document feeding operation. If the flag TMFLG2 has not been reset (NO, step P17), the timer TM2 continuously counts time. When the timer TM2 has counted 5 seconds (YES, step P19), the control section 80 cancels the SADF mode and stops a document feeding operation (step P7), displays the SADF mode inhibition message on the display (step P8), and replaces the SADF mode with the ADF mode. If the timer TM2 is short of 5 seconds (NO, step S19), the program returns to the main program. It should be noted that 5 seconds mentioned above is only illustrative and may, of course, be replaced with any other period of time suiting a particular operation.

The operation of the illustrative embodiment is as follows. To begin with, assume that the operator has stacked multiple documents 17, caused them to abut against the stop 41, selected the ADF mode on the mode selecting means, and then pressed the start key. Then, the clutch 35 is coupled, and the motor 32 is energized. This causes the shaft 30 and, therefore, the feed roller 22 to rotated in the feed direction. At the same time, the shaft 31 and pulley 24 are rotated in the opposite direction to the feed direction, causing the separation belt 23 to move in the same direction in frictional contact with the feed roller 22. Subsequently, the lever 43 is rotated to lift the stop 41 while causing the press roller 42 to contact the document stack 17. The stack 17 is pressed by the pick-up roller 20 and driven toward the feed roller 22 by the pick-up rollers 19 and 20. In this condition, the lowermost document is fed out from the stack 17 to the pull-out rollers 26 and 27 due to the frictional contact of the belt 23 with the feed roller 22. The pull-out rollers 26 and 27 feed the document to the transport section 15. Then, the belt 63 of the transport section 15 conveys the document to the illuminating position on the glass platen 12. After the document has been illuminated by the scanning means 65, the belt 63 conveys it to the turn-over section 16. If the document is two-sided, the turn-over section 16 turns it over and feeds it again to the transport section 15. If the document is one-sided, it is directly discharged to the stacker 70.

On the other hand, assume that the operator has set a single document 29 on the table 13, caused it to abut against the stop 41, selected the SADF mode on the mode selecting means, and then pressed the start key. In this case, the clutch 35 is uncoupled, and the motor 32 is energized. This causes the shaft 30 and, therefore, the feed roller 22 to rotate in the feed direction. At the same time, the shaft 31 and pulley 24 are also rotated in the feed direction to move the separation belt 23 in the feed direction. As a result, the belt 23 is rotated with no friction acting between it and the feed roller 22. Subsequently, the lever 43 is rotated to lift the stop 41 and brings the press roller 42 into contact with the document 29. In this condition, the document 29 is positively held in contact with the pick-up roller 20. The document 29 is fed toward the feed roller 22 by the pick-up rollers 19 and 20. Thereafter, the document 29 is driven toward the pull-out rollers 26 and 27 by the belt 23 and feed roller 22. This is followed by the same procedure as described in relation to the ADF mode.

Further, assume that multiple documents 17 have been stacked on the table 13 despite that the SADF mode has been selected. Then, the thickness sensing means 90 determines that multiple documents have been loaded on the table 13, as stated earlier. In response, the main control section 80 inhibits the feed section 14 from feeding the documents 17, displays the SADF mode inhibition message on the display, and automatically replaces the SADF mode with the ADF mode. Also, when the start timer or the absence timer counts up 5 seconds, the control section 80 displays the SADF mode inhibition message and replaces the SADF mode with the ADF mode.

As stated above, in the illustrative embodiment, when multiple documents 17 are stacked on the table 13 and the ADF mode is selected, the separating member drive means 40 causes friction to act between the separation belt 23 and the feed roller 22. In this condition, the documents 17 are sequentially separated and fed to the transport section 15 via the feed roller 22. On the other hand, when a single document 29 is set on the table 13 and the SADF mode is selected, the belt 23 is rotated with no friction acting between it and the feed roller 22. As a result, the document is nipped and driven by the belt 23 and roller 22 to the transport section 15. This allows the document 29, e.g., cut and pasted document easy to be damaged to be fed without any displacement and without being subjected to a load. Furthermore, the pulley **22*a* has substantially the same cross-section as the feed roller 22 while the pulley 24*a* and belt 23*a* have substantially the same cross-sections as the pulley 24 and belt 23, respectively. The engaging members 22*a* and 24*a* are located outside of the transport path. The belt 23 is driven in the feed direction due to the contact resistance of the engaging members 22*a* and 24*a*. In such a configuration, the feed roller 22 and belt 23** are driven at the same speed and prevented from being displaced relative to each other.

The feed roller 22 and belt 23 contact each other over a predetermined area and form a turn-over path. The first meshing portion of the belt 23 is held in mesh with the second meshing portion of the pulley 24 or 25, whereby the belt 23 is continuously driven until the trailing edge of a document leaves it. It follows that the contact surfaces of the roller 22 and belt 23 are prevented from being displaced, while the document 29 is turned over by the turn-over path and driven toward the transport section 15 without any load acting thereon.

Furthermore, assume that multiple documents are set on the table 13 as determined by the thickness sensing means 90, when the time up to the start of a document feeding operation exceeds a predetermined time as counted by the start timer, or when the operator is absent for more than a predetermined period of time as counted by the absence timer. Then, the main control section 80 inhibits the feed section 14 from feeding a document, replaces the SADF mode with the ADF mode, and displays an SADF mode inhibition message on the display. Hence, when multiple documents are set on the table 13 despite that the SADF mode is set up, the documents are prevented from being fed out, damaged, or fed out together.

Figure 8:
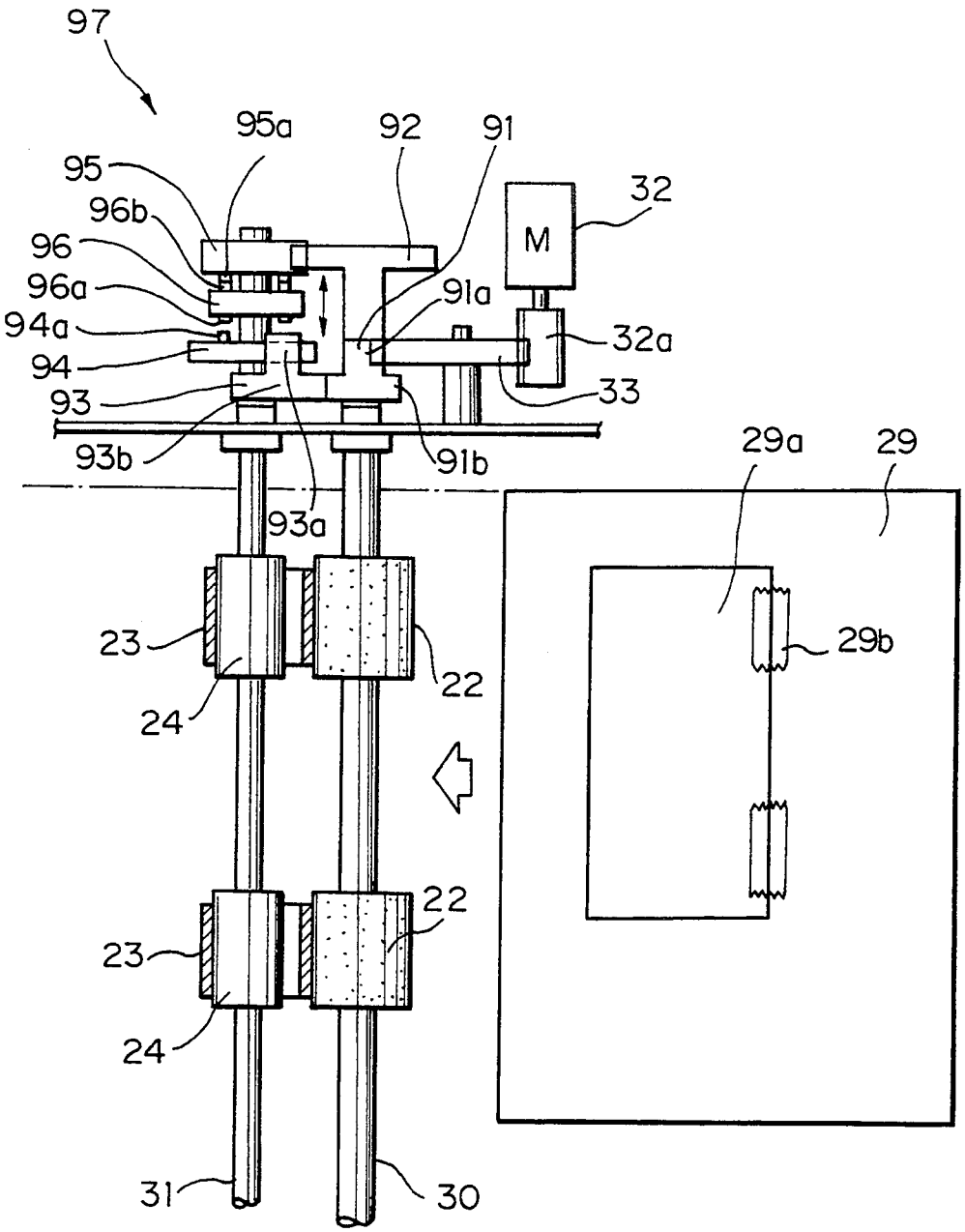
FIG. 8 is a fragmentary section showing an alternative embodiment of the present invention.
Figure 9:
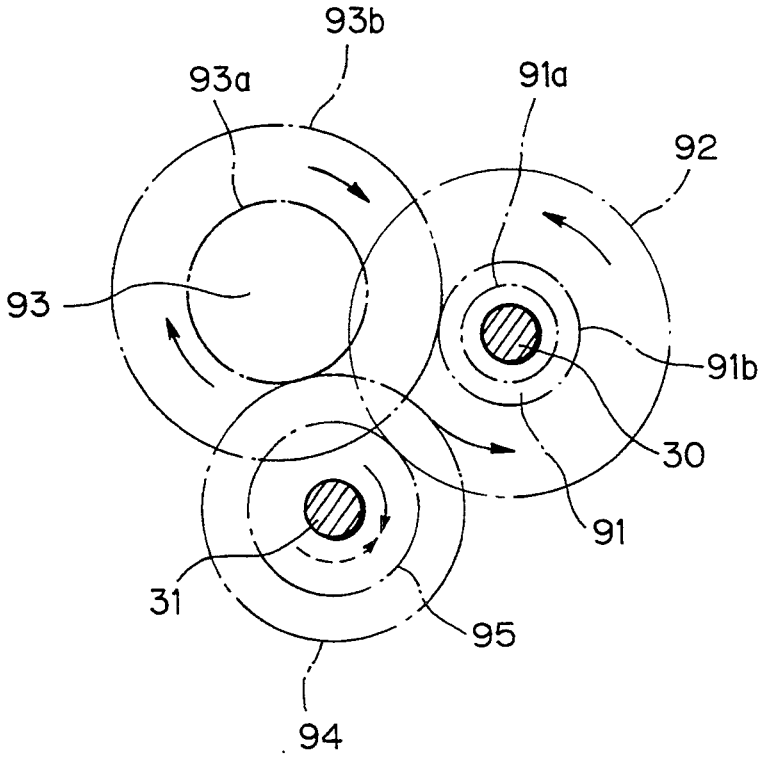
FIG. 9 is a view showing an essential part of the embodiment shown in FIG. 8.

Referring to FIGS. 8 and 9, an alternative embodiment of the present invention will be described. In this embodiment, the same or similar constituent parts as the parts of the previous embodiment are designated by the same reference numerals, and a detailed description thereof will not be made to avoid redundancy. As shown, gears 91 and 92 are coaxially mounted on the shaft 30 while gears 94 and 95 are rotatably mounted on the shaft 31. A gear 93 is affixed to a rotatable shaft, not shown. The gears 91 and 93 respectively have smaller diameter portions **91*a* and 93*a* and larger diameter portions 9*b* and 93*b*. The smaller diameter portions 91*a* and 93*a* are engaged with the gears 33 and 94, respectively. The larger diameter portions 91*b* and 93*b* are engaged with each other. A clutch plate 96 is mounted on the shaft 31 between the gears 94 and 95 and movable in the axial direction of the shaft 31. The clutch plate 96 and shaft 31 are interlocked to rotate in the same direction as each other. The clutch plate 96 has engaging portions 96*a* and 96*b* which are respectively engageable with engaging portions 94*a* and 95*a* included in the gears 94 and 95. When switching means, not shown, moves the clutch plate 96 toward the gear 94 or 95 as indicated by an arrow in FIG. 8, the engaging portion 96*a* or 96*b* of the clutch plate 96 engages with the engaging portion 94*a* of the gear 94 or the engaging portion 95*a* of the gear 95**.

In operation, when the ADF mode is selected on the mode selecting means, the switching means moves the clutch plate 96 toward the gear 94 to bring the engaging portion **96*a* into engagement with the engaging portion 94*a* of the gear 94. As a result, the clutch plate 96 and shaft 31 are rotated by the gear 94 in the opposite direction to the feed direction, as indicated by a phantom arrow in FIG. 9. In this condition, the belt 23 is rotated in frictional contact with the feed roller 22 in the direction indicated by a phantom arrow in FIG. 1. On the other hand, when the SADF mode is selected, the clutch plate 96 is moved such that the engaging portion 96 thereof engages with the engaging portion 95*a* of the gear 95. Consequently, the clutch plate 96 and shaft 31 are rotated in the feed direction, as indicated by a solid arrow in FIG. 9. This causes the belt 23 to move in the direction indicated by a solid arrow in FIG. 1. It is to be noted that the diameters of the gears 92 and 95 are selected such that the feed roller 22 and belt 23 move at the same speed. The gears 91–95, therefore, constitute separating member drive means 97** in combination.

This embodiment has the following advantages in addition to the advantages achievable with the previous embodiment. Since the rotation of the motor 32 is transmitted by the gears 91–95 and clutch 96, the separating member drive means 97 is small size. Further, when the SADF mode is selected, the separation belt 23 can be driven at the same speed as the feed roller 22.

FIGS. 10–13 show another alternative embodiment of the present invention. In this embodiment, the same or similar constituent parts as the parts of the previous embodiment are also designated by the same reference numerals, and a detailed description thereof will not be made to avoid redundancy. As shown, the embodiment includes a discharge section 100 for returning a document driven out of the turn-over section 16 to the top of the stack present on the table 13. The discharge section 100 has a discharge unit 101 movable on the table 13 in the feed direction, an end fence 102 movable in association with the discharge unit 101, and an intermediate belt 103 for conveying a document driven out of the turn-over section 16 to the discharge unit 101. The discharge unit 101 has a guide 104 forming a discharge path extending from the belt 103 side to the document set portion 18 of the table 13, and a plurality of pairs of discharge rollers 105 and 106 arranged along the guide 104. When documents are set at a position where they abut against a stop 141, moving means, not shown, moves the discharge section 100 to a position where the leading edge of the document stack is located. The end fence 102 forces the documents toward the separation roller 43 at the same time as the discharge section 100 is brought to the above-mentioned position.

The discharge unit 101 is provided with a lever 107 for selecting either of the ADF mode and SADF mode. A sensor 108 is positioned at the right-hand side of the ADF 11, as viewed in FIG. 10, so as to sense the lever 107. Specifically, when the discharge unit 101 is moved to the rear (position B, FIG. 12) of the rear end of the maximum allowable document size (position A, FIG. 12), the sensor 108 senses the lever 107 and informs such a position of the discharge unit 101 to the main control section 80. In response, the main control section 80 sets up the SADF mode in place of the ADF mode. The SADF mode is cancelled when the discharge unit 101 is moved into the range of the maximum allowable document size. A simple tray independent of the table 13 may advantageously be provided in the vicinity of the outlet of the discharge section 100 so as to receive documents undergone illumination. This will allow the next document to be fed without being obstructed by the document discharged previously.

The stop 141 separates the documents tacked on the table 13 and the documents discharged from the discharge unit 101 from each other. Specifically, the stop 141 is spaced substantially 1 millimeter from the surface of the table 13. In this position, the stop 141 stops documents discharged from the discharge section 100 with the downstream end thereof with respect to the feed direction, thereby preventing the documents from skewing. At the same time, the stop 141 separates the documents 17 initially stacked on the table 13 from the documents sequentially driven out of the discharge unit 101 onto the top of the stack 17. The above-mentioned end of the stop 141 is coated with Teflon or similar substance to reduce friction. The other end of the stop 141 is supported by the side walls, not shown, of the SADF 11 to be movable up and down. A solenoid, not shown, is mounted on the SADF selectively moves the stop 141 to a solid line position or a dashed line position shown in FIG. 10. When the stop 141 is raised by the solenoid, the documents discharged onto the top of the stack 17 can be fed again.

Figure 10:
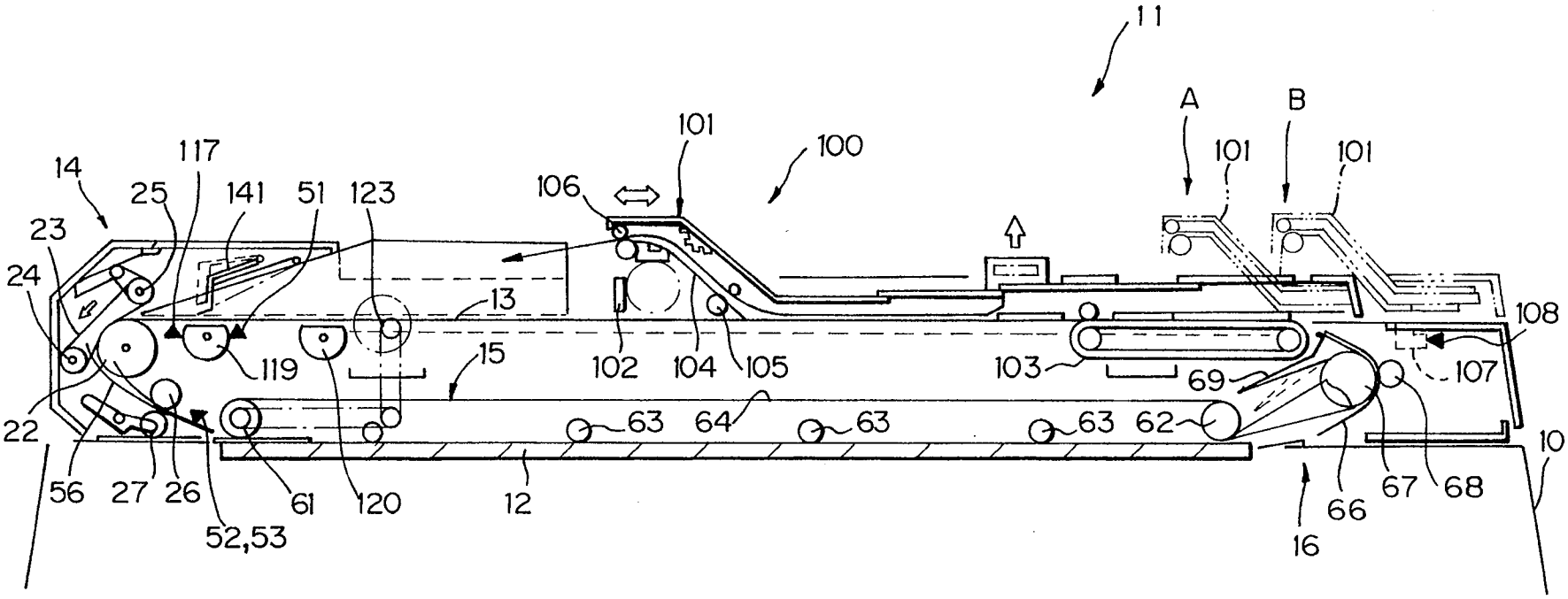
FIG. 10 is a section showing another alternative embodiment of the present invention.

More specifically, assume that the discharge unit 101 is moved to the position B of FIG. 10 to set up the SADF mode, and then the start key of the copier body 10 is pressed. Then, the above-mentioned solenoid raises the stop 141 away from a document set on the table 13 in response to a control signal from the main control section 80. At the same time, the discharge unit 101 is moved to a position lying in the maximum allowable document size. When the SADF mode is cancelled, the solenoid is deenergized to lower the stop 141. In this position, the stop 141 awaits an ADF mode operation.

Figure 12:
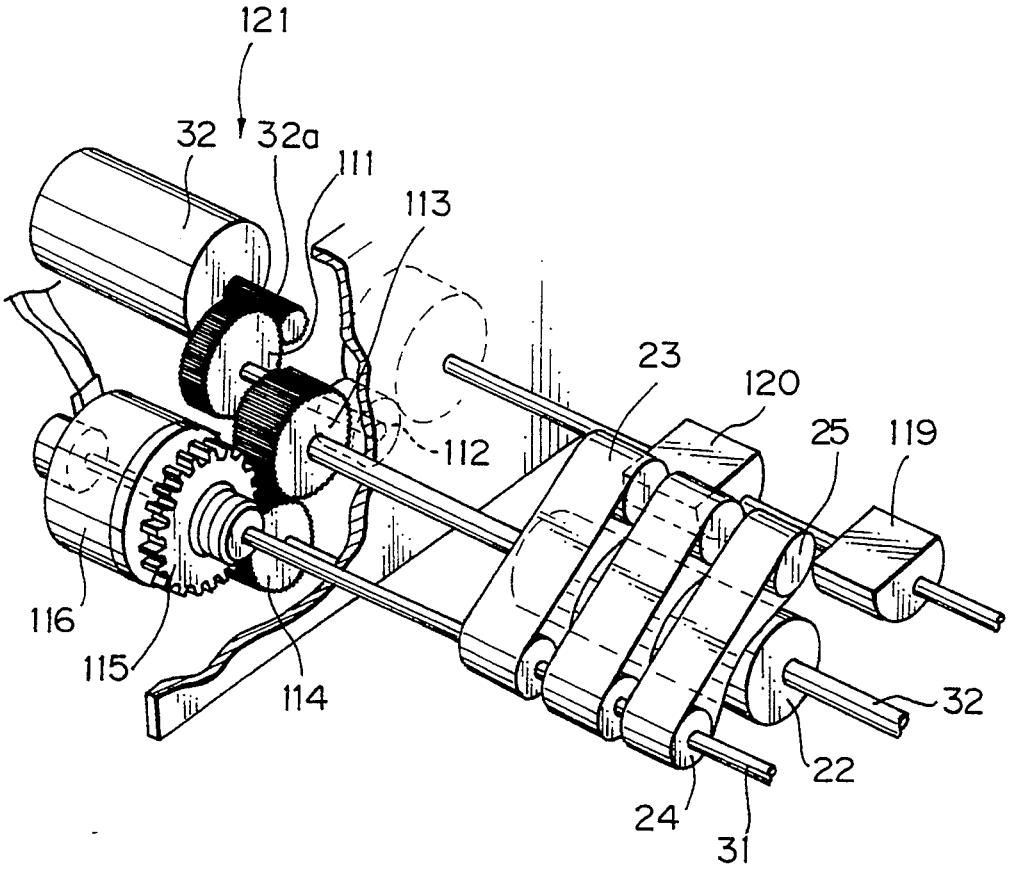
FIG. 12 is a perspective view of the embodiment shown in FIG. 10.

As shown in FIG. 12, the rotation of the motor 32 is transmitted to the shaft 30 via the motor gear 32 and gears 111, 112 and 113 and to the shaft 31 via the gear 113 and a gear 114. A clutch 116 rotates the shaft 31 reversibly by switching the rotation of the gear 115 in response to a control signal sent from the main control section 80. In this sense, the gears 111–114 and clutch 116 constitute separating member drive means 121 in combination.

Figure 11:
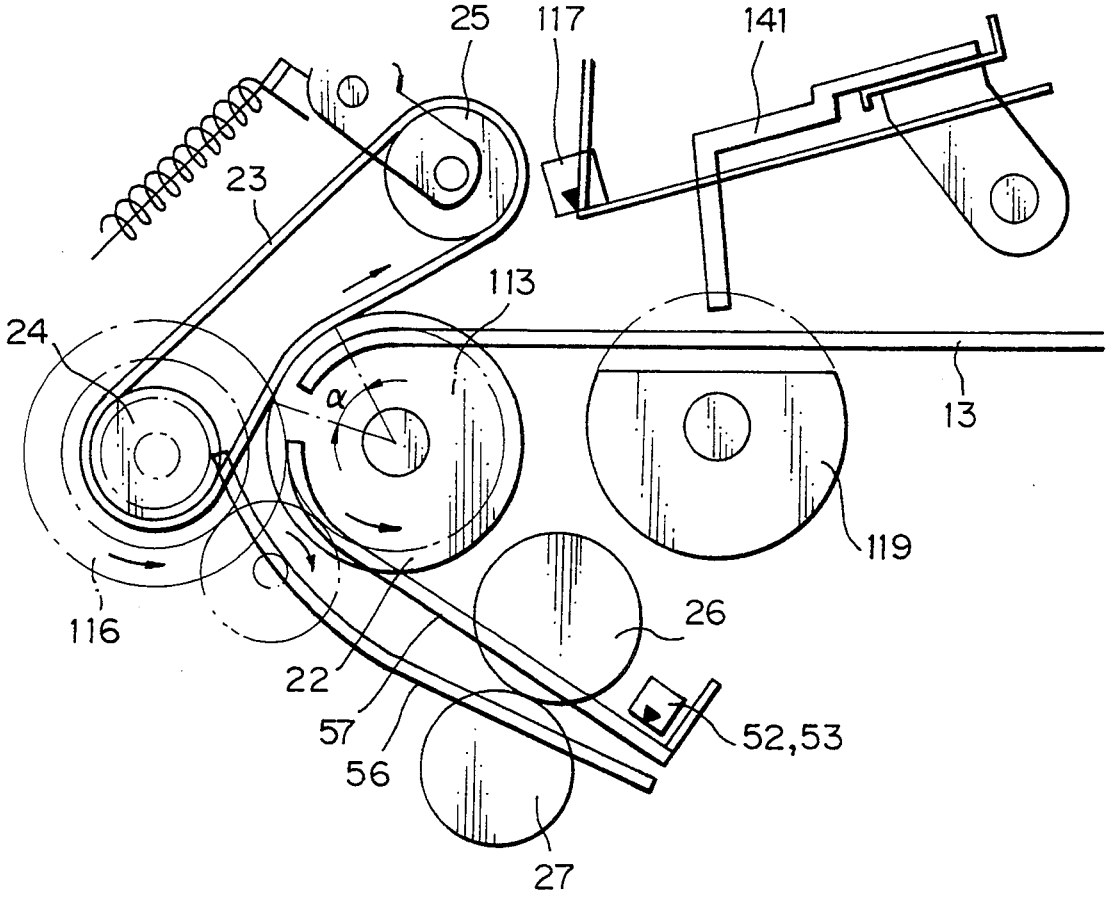
FIG. 11 is a fragmentary section of the embodiment shown in FIG. 10.
Figure 13:
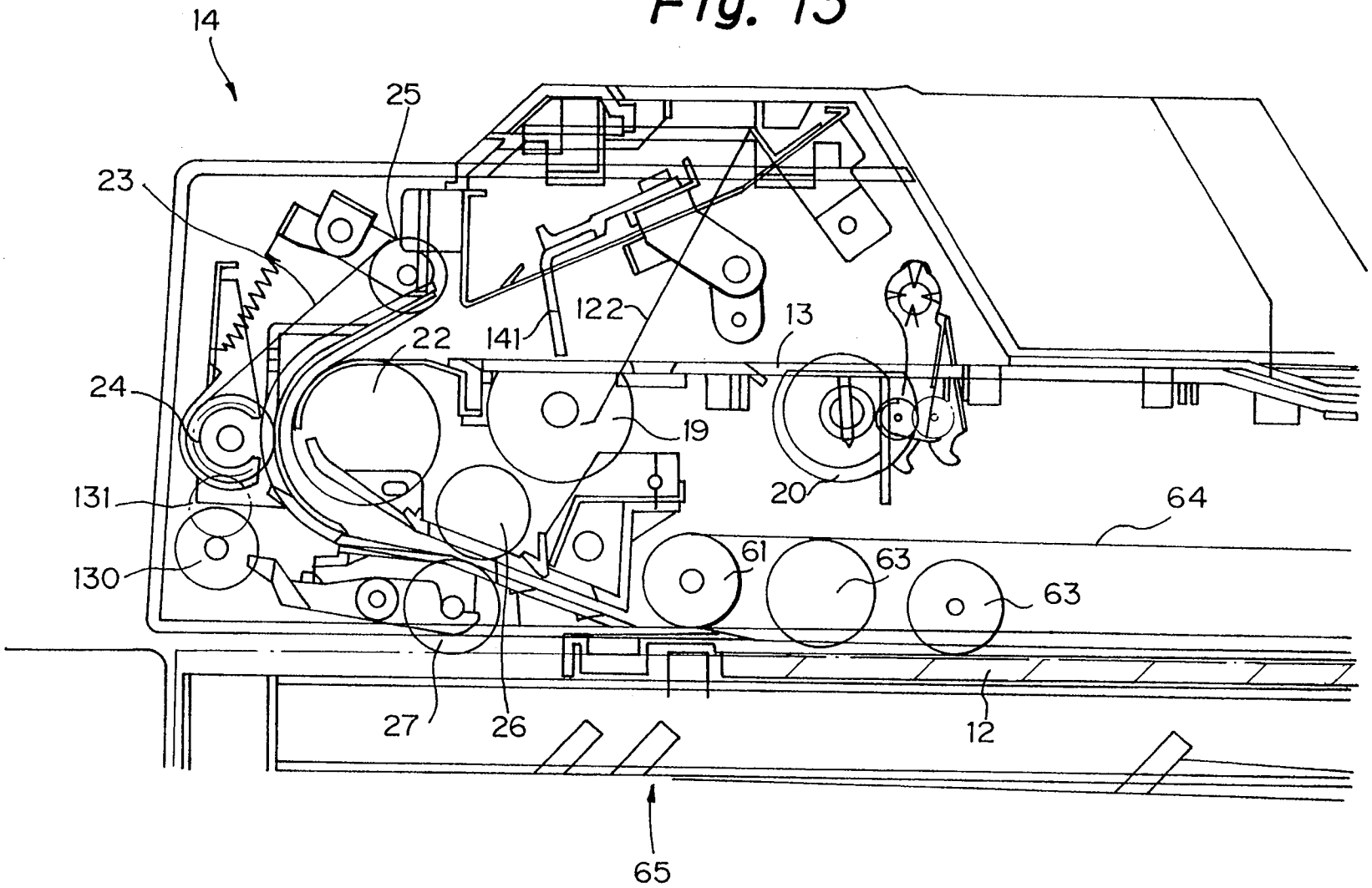
FIG. 13 is a fragmentary section showing a modified form of the embodiment shown in FIG. 10.

As shown in FIG. 11, a sensor 117 is located in front of the stop 141 so as to sense the trailing end of the document stack, i.e., the separation of the documents initially set and the documents driven out of the discharge section 100. Partly removed pick-up rollers 119 and 120 drive the documents set on the table 13 toward the feed roller 22. In FIG. 13, the reference numeral 122 designates a flexible member made of Mylar and movable in the up-and-down direction for pressing the documents to be fed. A motor 123, FIG. 10, drives the transport belt 64. As shown in FIG. 13, a motor 130 and a gear 131 may be exclusively assigned to the pulley 24. Such an independent drive source for the pulley 24 will facilitate the adjustment for equalizing the speeds of the belt 23 and roller 22.

As stated above, when the discharge unit 101 is moved to a position matching the document size, the ADF mode is set up automatically. When the discharge unit 101 is moved away from the feed section 14 to the outside of the maximum allowable document size, the SADF mode is set up automatically. Hence, this embodiment has an advantage that the selection of the ADF mode and SADF mode is simplified, in addition to the advantages described previously.

In summary, it will be seen that the present invention provides an ADF capable of feeding even a cut and pasted document or similar document easy to be damaged only if a single feed mode is selected on mode selecting means. In this mode operation, the document is free from loads and displacements. A feeding member and a separating member can be driven at the same speed to prevent the contacting surfaces thereof from being displaced relative to each other. This is successful in surely preventing documents from being damaged. The documents can be turned over without any damage. Moreover, when multiple documents are set on a table despite that the single feed mode is set up, the ADF does not start on a feeding operation and, therefore, protects the documents from damage and defective feed.

Various modifications will become possible for those skilled in the art after receiving the teachings of the present disclosure without departing from the scope thereof.

What is claimed is:

1. An automatic document feeder (ADF) for an image forming apparatus, comprising:

a table to be selectively loaded with multiple documents or a single document;

transporting means for transporting the document fed from said table to a predetermined position on a glass platen included in a body of said image forming apparatus, and then transporting said document away from said predetermined position;

feeding means comprising a feeding member for feeding the document from said table to said transporting means, and a separating member movable in opposite direction to an intended direction of document feed into engagement with said feeding member;

mode selecting means for selecting either of a multiple feed mode for sequentially feeding the multiple documents from said table while separating the individual documents, and a single feed mode for feeding the single document from said table;

drive means for driving said separating member while switching a drive direction of said separating member; and control means for controlling said drive means such that when said multiple feed mode is selected, said separating member contacts said feeding member with friction acting therebetween, while when said single feed mode is selected, said separating member contacts said feeding member without friction.

2. An ADF as claimed in claim 1, wherein said drive means comprises:

a first engaging member substantially identical with said feeding member in a cross-section perpendicular to an axis of said feeding member, and mounted on a same drive shaft as said feeding member;

a second engaging member substantially identical with said separating member in a cross-section perpendicular to an axis of said separating member, and mounted on a same drive shaft as said separating member;

said first and second engaging members engaging with each other and positioned at a side of a document feed path to prevent the document from being fed thereto;

said feeding member and said first engaging member being driven, when said second engaging member contacts said first engaging member under friction due to contact resistance acting therebetween, in said intended direction of document feed while said second engaging member and said separating member being driven in said intended direction of document feed.

3. An ADF as claimed in claim 1, wherein when said single feed mode is selected on said mode selecting means, said control means drives said separating member until the trailing edge of the document fed moves away from said separating member.

4. An ADF as claimed in claim 1, wherein the document is laid on said table face up, said feeding means feeds said document to said transporting means while turning over said document;

said feeding member comprising a roller;

said separating member comprising a pair of pulleys, and a belt passed over said pair of pulleys and contacting said feeding member over a predetermined area;

said belt forming a turn-over path for turning over the document by contacting said feeding member over said predetermined area.

5. An ADF as claimed in claim 1, wherein said separating member comprises:

a belt provided with a first meshing portion; and a pair of pulleys at least one of which is provided with a second meshing portion meshing with said first meshing portion.

6. An ADF as claimed in claim 1, further comprising a start timer for counting an interval between selection of said single document feed mode and a start of a document feeding operation, said control means replacing said single feed mode with said multiple feed mode when said start timer reaches a predetermined period of time.

7. An ADF as claimed in claim 1, further comprising:

operator detecting means for determining whether or not an operator is present at a predetermined position; and an absence timer for counting a period of time for which the operator is away from said predetermined position;

said control means replacing said single feed mode with said multiple feed mode when said absence timer reaches a predetermined period of time.

8. An ADF as claimed in claim 1, further comprising:

thickness sensing means for sensing a total thickness of the documents set on said table; and display means for displaying a message for inhibiting said single feed mode;

said control means inhibiting, when said single feed mode is selected and the multiple documents are set on said table as determined by said thickness sensing means, said feeding means from operating, replacing said single feed mode with said multiple feed mode, and causing said display means to display said message.

9. The ADF of claim 1, wherein said control means controls said feeding means such that said feeding member is driven at the same speed as said separating member.

* * * * *

UNITED STATES PATENT AND TRADEMARK OFFICE

CERTIFICATE OF CORRECTION

PATENT NO. : 5,344,134

DATED : September 6, 1994

INVENTOR(S) : Shirou Saeki et al.

It is certified that error appears in the above-indentified patent and that said Letters Patent is hereby corrected as shown below:

On the title page, after the Abstract, "13 Drawing Sheets", should be changed to read: --14 Drawing Sheets--.

Signed and Sealed this

Twenty-first Day of February, 1995

*Attest:*

Bruce Lehman

BRUCE LEHMAN

*Attesting Officer*

*Commissioner of Patents and Trademarks*